US006861113B2

(12) United States Patent
Kranz et al.

(10) Patent No.: US 6,861,113 B2
(45) Date of Patent: Mar. 1, 2005

(54) RECORDING PAPER THAT CAN BE PRINTED ON THE REVERSE

(75) Inventors: Erich Kranz, Flensburg (DE); Matthias Marx, Nortorf (DE)

(73) Assignee: Mitsubishi HiTec Paper Flensburg GmbH, Flensburg (DE)

( * ) Notice: Subject to any disclaimer, the term of this patent is extended or adjusted under 35 U.S.C. 154(b) by 60 days.

(21) Appl. No.: 10/239,661

(22) PCT Filed: Mar. 7, 2001

(86) PCT No.: PCT/EP01/02552

§ 371 (c)(1),
(2), (4) Date: Sep. 24, 2002

(87) PCT Pub. No.: WO01/72528

PCT Pub. Date: Oct. 4, 2001

(65) Prior Publication Data

US 2003/0087093 A1 May 8, 2003

(30) Foreign Application Priority Data

Mar. 24, 2000 (DE) ..... 100 14 351

(51) Int. Cl.[7] ..... B41M 5/40
(52) U.S. Cl. ..... 428/32.22
(58) Field of Search ..... 428/32.22

(56) References Cited

U.S. PATENT DOCUMENTS

| | | | | |
|---|---|---|---|---|
| 4,593,298 A | | 6/1986 | Ikeda et al. | 346/200 |
| 5,851,651 A | * | 12/1998 | Chao | 428/327 |
| 5,891,827 A | | 4/1999 | Brust et al. | 503/227 |
| 5,908,723 A | * | 6/1999 | Malhotra et al. | 430/31 |
| 5,989,701 A | | 11/1999 | Goetzen et al. | 428/327 |
| 6,001,490 A | | 12/1999 | Rienäcker et al. | 428/480 |

FOREIGN PATENT DOCUMENTS

| | | | |
|---|---|---|---|
| DE | 32 07 071 | 1/1987 | B41M/5/18 |
| DE | 36 21 732 | 1/1988 | D21H/1/00 |
| DE | 195 32 303 | 12/1997 | B41M/5/00 |
| DE | 37 20 171 | 2/1998 | B41M/5/18 |
| DE | 197 48 258 | 5/1999 | B41M/5/40 |
| EP | 0 120 095 | 10/1984 | D21H/1/22 |
| EP | 0 171 810 | 2/1986 | B41M/5/26 |
| EP | 0 190 875 | 8/1986 | B41M/5/26 |
| EP | 0 400 485 A2 | 12/1990 | |
| EP | 0 402 041 | 12/1990 | B41M/5/20 |
| EP | 0 518 552 | 12/1992 | B41M/5/40 |
| EP | 0 887 199 | 12/1998 | B41M/5/00 |
| EP | 0 893 271 | 1/1999 | B41M/5/00 |
| EP | 0 900 668 | 3/1999 | B41M/5/00 |
| GB | 2 163 271 | 2/1986 | B41M/5/26 |

OTHER PUBLICATIONS

Patent Abstracts of Japan, 08072384, Mar. 1996.

Partial translation of Japanese Unexamined Patent Publication No. 24388/1993.

Partial translation of Japanese Unexamined Patent Publication No. 42763/1993.

* cited by examiner

*Primary Examiner*—B. Shewareged
(74) *Attorney, Agent, or Firm*—Cohen, Pontani, Lieberman & Pavane

(57) ABSTRACT

Recording paper includes a stock sizing and/or surface preparation, a front side for receiving recordings and a reverse side configured differently from the front. The reverse exhibits excellent printability coupled with improved drying of printing inks when using offset printing inks that contain functional pigments and in particular magnetizable particles, while preventing the printable ink and the functional pigments, in particular the magnetizable particles, from penetrating too deeply into the paper.

14 Claims, No Drawings

RECORDING PAPER THAT CAN BE PRINTED ON THE REVERSE

PRIORITY CLAIM

This is a U.S. national stage of application No. PCT/EP 01/02552, filed on Mar. 07, 2001. Priority is claimed on that application and on the following application: Country: Germany, Application No.: 100 14 351.2, Filed: Mar. 24, 2000.

BACKGROUND OF THE INVENTION

1. Field of the Invention

The invention concerns a recording paper with an internal size and a reverse side surface preparation, whose front side is intended for receiving recordings, and whose reverse side has a different structure from the front side and can be printed with a printing ink that contains functional pigments. The invention also concerns the use of the recording paper of the invention.

2. Description of the Invention

There are many different kinds of paper or cardboard substrates that are intended for recording, especially substrates of this type whose front side has a coating or preparation intended for certain recording processes and whose reverse side has a different coating or preparation from the front side.

EP 0 120 095 A1 describes a cast coating process, in which water is applied to the reverse side in amounts of 1–30 g/m$^2$ by jets or screen rolls to prevent curling in the coating machine. The moistening water may also contain starch, protein, synthetic sizing agents, wax emulsions, wetting agents and pigments.

DE 3 621 732 A1 describes a process, in which, to prevent curling during the production of paper or cardboard that is treated on one side, especially paper that is coated on one side, the untreated or uncoated side is passed through a water tank, so that the paper web absorbs a sufficient amount of moisture over the entire width of the web, and is then dried as usual.

EP 0 402 041 describes a heat-sensitive recording material, in which wrinkling of the paper sheet to be used as the substrate is to be reduced by selecting certain types of pulp. The paper sheet preferably contains the usual papermaking additives, e.g., strength additives, such as cationic starch, sizing agents, such as cationic and anionic polyacrylamides or salts of fatty acids, sizes based on AKD or on an alkenyl succinic acid, agents for improving wet-web strength, and inorganic fillers. Preferably, the paper sheet is also impregnated with aqueous solutions of polymers applied by a size press, such as polyvinyl alcohol, starch, SBR latex, or styrene-maleic anhydride copolymer.

The prior art discussed below includes several proposals which seek to improve recording quality by making available a substrate with a certain smoothness and a certain water-absorption capacity. In this regard, these previous proposals differ considerably in the proposed values for smoothness and water-absorption capacity.

With reference to JP-A-08072394, Patent Abstract of Japan describes a recording paper that is produced from a substrate, one of whose surfaces has a Cobb value in the range of 15–50 g/m$^2$ and an Oken smoothness value of 40–400 s. The smoothness and Cobb value of the finished recording paper are not disclosed.

GB 2 163 271 A also proposes a special substrate for obtaining a heat-sensitive recording paper with improved recording density and superior point reproducibility, which is intended especially to make possible a high printing speed of the recording paper in a thermal printer. In the case of this previously known substrate, an interlaminar strength of 0.5 to 2.0 kg cm by TAPPI UM 528 and a Cobb value of 10–20 g/m$^2$ by JIS P 81440 are adjusted by the selection of the pulps and by specific addition of surface sizing agents and other additives. The substrate is supposed to have a Bekk smoothness in accordance with JIS P 8119 of at least 200 s. According to statements in the patent specification, both the Cobb and Bekk values refer to the front surface, on which the heat-sensitive recording coating is applied. As the tables in this document show, good results are achieved with substrates with a Bekk smoothness of 254–402 s and a Cobb value of 14.9 to 18 g/m$^2$. Since it can be inferred from the description of the example that application of the heat-sensitive recording coating is followed by a calendering step, it may be assumed that the smoothness of the finishing recording papers is even higher than the values disclosed for the various substrates. Coating of the reverse side of the substrate with a latex dispersion or water-soluble polymers is designed to prevent wrinkling of the substrate. Cobb or smoothness values are not disclosed for the surface on the opposite side from the recording coating either for the substrates provided with a heat-sensitive recording coating or for substrates without a recording coating.

EP 0 887 199 A2 proposes a printing material for ink-jet printing, in which the paper substrate is supposed to have a density of 1.01 g/cm$^3$ or more and a degree of sizing (determined as the Cobb value) of 1–15 g/m$^2$, and preferably 2–11 g/m$^2$. The goal of this proposal is to minimize the wrinkling of the recording material during printing with aqueous ink by making available a substrate with low unevenness for the production of recording materials with improved image definition. Even though smoothness values for the substrate and the finished recording material are not disclosed, it may be assumed that the material has a relatively high smoothness due to several calendering operations, to which both the substrate and the recording paper that has been provided with a recording coating are subjected.

EP 0 190 875 A2 describes a recording material in which a heat-sensitive recording coating is applied to a surface-sized paper substrate that has a Cobb value of 25 g/m$^2$ or less, preferably 10 to 20 g/m$^{2*}$, as measured by JIS P 8140, which corresponds to DIN/EN 20535 or ISO 535. This proposal aims to achieve good contact with the thermal printing head to improve the recording quality.

EP 0 900 668 A2 provides for a substrate with a Cobb$_{60}$ value of 30–100 g/m$^2$ in accordance with JIS P 8140 for a recording material for ink-jet printing, which is to be produced by the cast-coating process. The substrate is supposed to have a smoothness of at least 30 s as measured by JAPAN TAPPI No. 5, and values of up to 60 s are disclosed as examples. Increased productivity in the production of cast-coated papers and improved ink absorption are strived for with the substrate.

Finally, DE 195 32 303 C2 discloses a recording material for ink-jet printing, in which a support material based on a synthetic thermoplastic polymer is used, which has a Cobb$_{12}$ value of at least 30 g/m$^2$ in accordance with ISO 535 ($E_{1976}$). The recording material produced in this way is intended to overcome the stated disadvantages of long-lasting, complete absorption of applied ink within the ink-jet printing process, especially in the case of large-area recording, such as images, and to guarantee the use of a recording material produced in this way even in ink-jet printers with exacting requirements on the recording material to be used.

To improve the recording quality, especially the permanence of the recording on heat-sensitive recording materials, various proposals have also been made for coatings of the reverse side.

DE 197 48 258 A1 discloses a reverse-side coating, which, in a heat-sensitive recording material, produces a barrier effect against substances used in offset printing and flexographic printing, against organic solvents, and against oils, fats, and softeners. This is intended to prevent discoloration of the heat-sensitive recording coating applied to the front side and to prevent the associated unrecognizability of the typeface produced on the recording coating. This document also cites the following prior-art documents, which are discussed in detail below: DE-C-32 07 071, U.S. Pat. No. 4,593,298, EP-B-0 171 810, EP-A-0 518 552, and DE-A-37 20 171. These documents pertain to heat-sensitive recording materials with reverse-side preparations or coatings, the purpose of which is to improve water resistance and the permanence of the recorded image, to achieve a barrier effect, or to reduce crinkling and curling.

For example, in accordance with DE-C-32 07 071, the reverse-side coating is designed to prevent the penetration of softeners into heat-sensitive recording material used for labels on plastic packages.

The goal of U.S. Pat. No. 4,593,298 is to make available a heat-sensitive recording paper that runs well in thermal printers, shows the least possible curling and is highly resistant to water. The last characteristic is necessary to prevent blocking of rolled recording paper at high levels of atmospheric humidity. This document proposes a heat-sensitive paper with a protective coating applied over the recording coating and with a reverse-side coating that contains a styrene-maleic anhydride copolymer. To guarantee optimum running properties, the document proposes a Bekk smoothness of 30–500 s, and preferably 80–150 s, for the reverse side of the previously known recording paper. It provides no information about Cobb values of the recording coating and especially of the reverse side of the recording paper.

EP-B-0 171 810 describes a heat-sensitive recording material with superior durability and permanence that provides a clear image and high dynamic image density. To this end, the document provides for a reverse side coating that contains a polyurethane-based emulsion binder in addition to a protective coating that covers the heat-sensitive recording coating. Whereas no values are given for the smoothness and water-absorption capacity of the reverse-side coating, examples of smoothness values for the upper coating are specified as 200–300 s and 600–1,000 s, although the measuring method is not specified.

EP-A-0 518 552 provides for a reverse-side coating of a substrate that contains a thermoplastic resin in a heat-sensitive recording material. Substrates that are considered are synthetic papers and especially plastic foils. This is designed to limit potential shrinkage to 1–2%.

DE-A-37 20 171 describes a heat-sensitive recording material to be used for labels. The reverse side of this material is provided with an adhesive coating, whose water-absorption capacity and smoothness are not disclosed.

To limit swelling of the paper substrate by ink penetration of a recording material for ink-jet printing, which possibly has several superimposed coatings that are receptive to ink, EP 0 893 271 A1 provides for a water-repellent coating that contains an inorganic filler and a synthetic binder, which is formed at least on the side of the paper substrate and serves as the substrate for the recording coating. The water-repellent coating is formed with a maximum weight per unit area of 7 g/m$^2$, and paper provided with this coating has a maximum $Cobb_{30}$ value of 5 g/m$^2$ in accordance with ISO 535 ($E_{1991}$).

Although the previously known recording materials have proven effective in a wide range of applications, new areas of application are continually developing, and at the same time quality requirements are increasing, so that it is necessary continually to find new solutions to meet these evolving requirements. In particular, heat-sensitive recording materials and papers for ink-jet printing are being used to an increasing extent to produce tickets that have a so-called preprint on the reverse side. These preprints may contain, for example, functional pigments incorporated in the printing ink, especially magnetizable particles with a high perecntage of, for example, iron powder or magnetite.

Extensive series of tests with heat-sensitive recording materials that have these types of barrier coatings on the reverse side have shown that the printability of the reverse side of previously known recording papers has not yet been optimized. Therefore, previously known barrier coatings are still not suitable for different applications in all cases. In particular, the offset printability and the perfect functioning of magnetizable pigments applied by offset printing are not yet ensured with a sufficiently high degree of certainty. It was found that the strength of the magnetic flux that emanates from magnetizable particles is not sufficient if the particles penetrate the paper along with the printing ink and are no longer present on the surface of the reverse side of the paper. As a result, data is incompletely or incorrectly recorded in the preprints by a magnetic head.

A previously used method for preventing excessively deep penetration of the reverse side of recording materials by printing ink and by the functional pigments incorporated in the ink is to underlay the printing ink with a primer coat, i.e., a paint-like coating of printing ink, to seal the paper surface within the printing process. However, this method has the considerable disadvantage that a freely available printing unit is required during the printing process, which is often not the case, especially when multicolor printing is being done.

SUMMARY OF THE INVENTION

Proceeding from the problems described above, the goal of the present invention is to develop a recording paper, especially for heat-sensitive recording or for ink-jet printing, which, while retaining good recording quality and a low degree of curling and wrinkling, also has a reverse side, which (a) on the one hand, prevents excessively deep penetration by a printing ink that contains functional pigments, such as magnetizable particles, but, on the other hand, allows it to adhere sufficiently, so that (b) after the printed paper web has been rolled up on a reel, there is no interfering adhesion with the front side of the paper web, and printing ink applied to the reverse side is not deposited on the front side of the paper web.

Surprisingly, the tests on which the invention is based demonstrated that these partially conflicting requirements can be met by a single recording paper, if the reverse side of the recording paper has a water-absorption capacity that falls within a certain range and a smoothness that falls within a certain range. It was recognized that excessive smoothness of the recording paper leads to processing problems, including problems with the paper feed in the printing equipment, especially in the case of heat-sensitive recording papers.

Therefore, for a recording paper provided with internal sizing and a reverse side a surface preparation, whose front side is intended for receiving recordings, and whose reverse side has a different structure from the front side and can be printed with a printing ink that contains functional pigments, the invention provides that the reverse side of the recording paper has an additional surface preparation, which is applied by means of an aqueous solution that contains dimeric alkyltene (alkyl ketene dimmer or AKD), styrene maleic anhydride copolymer, starch, polyvinyl alcohol, alginate, or CMC or is applied by means of a dispersion of a synthetic binder. The reverse side has a $Cobb_{60}$ value X such that 15 $g/m^2 < X \leqq 25$ $g/m^2$ a mean Bekk smoothness Y such that $Y \leqq 200$ s.

In accordance with the invention, only the combination of an internal size and an additional surface preparation with a specific range of reverse-side water-absorption capacity with a specific range of reverse-side smoothness makes it possible to achieve the goal of the invention in its entirety, which includes not only reduction of printing ink penetration and outstanding reverse-side printability, but also a lasting solution to the problem of unwanted ink deposition, specifically, the transfer of still insufficiently dried ink during the printing process to the front side of the recording paper in the delivery stack or in the finished roll of printed paper.

The preprints mentioned earlier in the specification are defined in accordance with the invention as imprints and surface-covering coatings that are applied to the reverse side of the recording paper after the paper production process.

The $Cobb_{60}$ values specified in the specification and claims were determined by the method specified in DIN/EN 20535 or ISO 535 with distilled water at 20° C.

The mean Bekk smoothness in accordance with this invention is the arithmetic mean of a fixed number of individual web measurements of the Bekk smoothness in seconds. For this purpose, the width of the paper web is divided into a specific number of partial widths, for each of which the Bekk smoothness in seconds is determined by the method specified in DIN 53107 or corresponding International Standard ISO 5627. The individual web values determined in this way, which themselves already represent arithmetic mean values from 10 individual measures values in accordance with DIN 53107 or corresponding International Standard ISO 5627, are added, and the sum is divided by the number of individual web measured values to obtain the mean Bekk smoothness in seconds.

A preferred range for the water-absorption capacity of the reverse side of the recording paper of the invention is a $Cobb_{60}$ value of not more than 23 $g/m^2$.

With respect to achieving the goal of the invention, extensive testing showed that especially good results are obtained with a recording paper, whose front side is intended for receiving recordings, if the reverse side has a Bekk smoothness of at least 160 s, and especially a Bekk smoothness of at least 175 s.

In tests conducted to determine the best type of internal sizing and/or reverse-side surface preparation, it was found that the best results were achieved with papers that were beater-sized with resin size. In accordance with another embodiment of the invention, the additional, reverse side surface preparation may be pigmented. Coating weights of 0.05 to 5 $g/m^2$ (oven-dry) are preferred for the additional surface preparation to be applied to the reverse side, and especially good results are achieved with coating weights of 0.07 to 0.3 $g/m^2$ (oven-dry).

An especially preferred embodiment of the surface sizing is the use of unpigmented solutions, which are possibly applied on the reverse side over a previously applied starch preparation.

The present invention is preferably used in the area of heat-sensitive recording papers, whose front side has a heat-sensitive recording coating that contains dye precursors and acceptors that react with one another under the influence of heat. Depending on the intended use, the heat-sensitive recording coating is applied over a pigmented intermediate coating and/or is provided with a protective coating.

The invention is also extremely well suited for use in the area of ink-jet recording papers. Ink-jet recording papers with or without an ink-receptive coating may be used, but those with an ink-receptive coating are especially preferred. A protective coating may be applied over the ink-receptive coating. One of the purposes of such a protective coating is to reduce or prevent smudging.

The reverse side of the recording papers of the invention can be printed or coated with a printing ink, which, in a preferred embodiment, contains up to 70 wt. % of functional pigments.

If the printing inks preprinted on the reverse side of the recording papers contain magnetizable functional pigments, of which those with remanent magnetization are preferred, the preprints applied, for example, in the form of bar codes or over a large area (in the case of remanently magnetizable functional pigments) can be decoded by special magnetic reading heads. The preprints printed on the reverse side of the recording papers thus contain or represent a magnetic information storage coating.

At a given weight per unit area of the magnetizable functional pigments that are applied to the reverse side of the recording papers, the magnetic flux emanating from this information storage coating is directly proportional to the pigment concentration and to the underlying coating thickness of the information storage coating on the penetration-preventing reverse side of the printed recording paper. When the information storage coating is guided past a magnetic reading head to decode it, a voltage is induced in the magnetic reading head, which is proportional to the change in magnetic flux with respect to time at the site of the magnetic reading head (due to the relative movement between the information storage coating and the magnetic reading head). To be able to generate the largest possible induced voltages in the magnetic reading head, high concentrations of magnetizable functional pigments in the information storage coating are necessary, and the recording paper in accordance with the invention makes it possible to achieve these high concentrations.

In this regard, outstanding results can be achieved with printing inks that contain iron powder or iron oxide as functional pigments incorporated in the printing ink (iron powder: e.g., magnetic pigment 025 produced by BASF, D-67056 Ludwigshafen; iron oxide, such as magnetite: e.g., magnetic pigment 340 or 345 produced by BASF, D-67056 Ludwigshafen).

To measure the voltage induced by the magnetic flux caused by the information storage coating printed on the recording paper, a measuring instrument is used, whose measured voltage values in mV (millivolts) can be used as a measure of the signal effect coming from the information storage coating.

360 mV was recognized as the minimum value for the induced voltage, above which there is a sufficient signal effect of the information storage coating.

It should be emphasized, however, that the concept of functional pigments should not be interpreted too narrowly in this invention and that, in general, functional pigments are to be understood to be pigments that are printed on the reverse side of the recording paper and have some intended function to perform. In addition to magnetizable functional pigments, we might also mention fluorescent, heat-sensitive, or coloring components and possibly encapsulated fragrances as further examples, although the invention is not limited to these examples.

In particular, printing inks that can be crosslinked by UV radiation have been found to be suitable. In the series of tests on which this invention is based, especially offset printing inks for the wet, dry, and waterless offset printing process were found to be suitable.

In regard to its use as a recording material that contains invisible redundant codes, the invention also provides for printing inks that are barely visible to the naked eye, such that the printing inks contain, for one thing, especially magnetizable functional pigments and, for another, ink pigments of high opacity in high concentration. In an especially preferred embodiment, the side of the recording material of the invention that has the printing ink that contains especially magnetizable functional pigments is covered with one or more additional colored or white imprinted coatings, which are as opaque as possible.

Especially preferred possible uses of the recording paper of the invention include use of the recording paper for reverse-side printing with a printing ink that contains functional pigments, especially a printing ink that contains up to 70 wt. % of functional pigments, such that magnetizable functional pigments are especially preferred, especially magnetizable functional pigments that contain or consist of iron oxide and/or iron powder. Furthermore, the recording paper of the invention is especially suitable for reverse-side printing with a printing ink that can be crosslinked by UV radiation, especially if the printing ink is covered with an additional imprinted coating.

DETAILED DESCRIPTION OF THE PRESENTLY PREFERRED EMBODIMENTS

The invention is illustrated by the following examples and comparison examples.

Production of a Base Web

A base web is produced from bleached and ground hardwood and softwood pulps with the addition of 0.6 wt. % (oven-dry) of resin size as an internal size as well as other customary additives, based on the solids content (oven-dry) of the base paper, with a weight per unit area of 65 g/m$^2$. A pigmented intermediate coating of 8 g/m$^2$ is applied to the front side, and a starch preparation of 0.3 g/m$^2$ is applied to the reverse side of the base paper.

Comparison Example 1

A heat-sensitive recording coating of 5 g/m$^2$ is applied to the intermediate coating of a web of the base paper whose production was described above. The heat-sensitive recording coating was coated with a pigmented protective coating of 2.2 g/m$^2$. The reverse side of the web of paper is acted upon by a 0.4% aqueous dispersion of a dimeric, cationically adjusted alkyltene to produce a coating of 0.016 g/m$^2$ (oven-dry). Bar codes are then applied by offset printing with a printing ink that contains magnetizable functional pigments.

Comparison Example 2

As specified in Comparison Example 1, another web of the same base paper is coated with a heat-sensitive recording coating and a protective coating. The reverse side of the web of paper is acted upon by a 1% aqueous dispersion of a dimeric, anionically adjusted alkytene to produce a coating of 0.04 g/m$^2$ (oven-dry). Bar codes are then imprinted as described in Comparison Example 1.

Comparison Example 3

The reverse side of the recording paper produced as described in Comparison Example 1 is provided with an additional treatment with a 0.4% aqueous dispersion of a dimeric, cationically adjusted alkyltene to produce an additional coating of 0.016 g/m$^2$ (oven-dry). Bar codes are then imprinted as described in Comparison Example 1.

Example 1 in Accordance with the Invention

The reverse side of the recording paper produced as described in Comparison Example 2 is provided with an additional treatment with a 1% aqueous dispersion of a dimeric, anionically adjusted alyltene to produce an additional coating of 0.04 g/m$^2$ (oven-dry). Bar codes are then imprinted as described in Comparison Example 1.

Example 2 in Accordance with the Invention

A heat-sensitive recording coating of 5.5 g/m$^2$ is applied to the intermediate coating of a web of base paper produced as described at the beginning. The heat-sensitive recording coating is then coated with a pigmented protective coating of 2.7 g/m$^2$. The reverse side of the web of paper is acted upon by a 3.5% aqueous dispersion of a dimeric, anionically adjusted alkyltene to produce a coating of 0.1 g/m$^2$ (oven-dry). Bar codes are then applied by offset printing with a printing ink that contains magnetizable functional pigments.

The following table shows that, compared with the comparison examples, the recording paper in accordance with the invention shows significantly reduced penetration of the printing ink applied by offset printing, which manifests itself in significantly reduced transfer of ink to the front side of the paper. At the same time, the recording paper of the invention guarantees a sufficiently high pigment concentration of the magnetizable functional pigments, which is associated with a sufficiently high magnetic flux of the magnetizable functional pigments contained in the printing ink imprinted on the reverse side.

| | Induced voltage of the magnetic flux (mv) Determined on the reverse side | | | | | | | Mean Bekk smoothness [s] of the reverse side | | | | | | | Transfer to the | Cobb value on |
|---|---|---|---|---|---|---|---|---|---|---|---|---|---|---|---|---|
| | TS 1 | 2 | 3 | 4 | 5 | FS 6 | Mean value | TS 1 | 2 | 3 | 4 | 5 | FS 6 | Mean value | front side | reverse side (g/m$^2$) |
| A | 370 | 380 | 360 | 360 | 380 | 350 | 367 | 200 | 208 | 190 | 192 | 200 | 160 | 192 | 3 | 32.4 |
| B | 470 | 420 | 420 | 420 | 470 | 380 | 430 | 210 | 212 | 223 | 225 | 212 | 215 | 215 | 4 | 18.4 |
| C | 420 | 410 | 400 | 410 | 350 | 340 | 388 | 198 | 205 | 212 | 207 | 215 | 205 | 207 | 3 | 23 |

-continued

| | Induced voltage of the magnetic flux (mv) Determined on the reverse side | | | | | | | Mean Bekk smoothness [s] of the reverse side | | | | | | | Transfer to the | Cobb value on |
|---|---|---|---|---|---|---|---|---|---|---|---|---|---|---|---|---|
| | TS 1 | 2 | 3 | 4 | 5 | FS 6 | Mean value | TS 1 | 2 | 3 | 4 | 5 | FS 6 | Mean value | front side | reverse side ($g/m^2$) |
| D | 400 | 380 | 390 | 400 | 390 | 380 | 390 | 187 | 215 | 220 | 223 | 221 | 209 | 213 | 3 | 16.7 |
| E | 380 | 370 | 380 | 390 | 390 | 380 | 382 | 181 | 194 | 195 | 179 | 193 | 189 | 189 | 1 | 22 |
| F | 400 | 420 | 390 | 410 | 400 | 410 | 405 | 195 | 180 | 182 | 178 | 183 | 192 | 185 | 1 | 18.5 |

A Base paper web
B–D Comparison examples 1–3
E–F Examples 1 and 2 in accordance with the invention
TS = drive end
FS = guide end
1 = very good
3 = still acceptable
4 = not acceptable

What is claimed is:

1. Recording paper with internal sizing and a reverse-side surface preparation, whose front side is intended for receiving recordings, and whose reverse side has a different structure from the front side and can be printed with a printing ink that contains functional pigments, wherein the reverse side of the recording paper has an additional surface preparation, which is applied by means of one of an aqueous solution that contains one of dimeric alkyltene, styrene-maleic anhydride copolymer, starch, polyvinyl alcohol, alginate, and carbomethyl cellulose (CDM), and a dispersion of a synthetic binder, and wherein the reverse side has a $Cobb_{60}$ value X such that 15 $g/m^2 \leqq X \leqq 25$ $g/m^2$ and a mean Bekk smoothness Y such that $Y \leqq 200$ s.

2. Recording paper in accordance with claim 1 wherein the reverse side has a $Cobb_{60}$ value X such that $X \leqq 23$ $g/m^2$.

3. Recording paper in accordance with claim 1 wherein the reverse side has a mean Bekk smoothness Y such that $Y \geqq 160$ s.

4. Recording paper in accordance with claim 1 wherein the reverse side has a mean Bekk smoothness Y such that $Y \geqq 175$ s.

5. Recording paper in accordance with claim 1 wherein the additional surface preparation is pigmented.

6. Recording paper in accordance with claim 1 wherein the front side of the recording paper has a heat-sensitive recording coating that contains dye precursors and acceptors that react with one another under the influence of heat.

7. Recording paper in accordance with claim 1 wherein the front side of the recording paper can be printed by the ink-jet printing process.

8. Recording paper in accordance with claim 1 wherein the front side of the recording paper has an ink-reception coating for the ink-jet printing process.

9. Recording paper in accordance with claim 1 wherein the reverse side of the recording paper is printed with a printing ink that contains functional pigments.

10. Recording paper in accordance with claim 9 wherein the reverse side of the recording paper is printed with a printing ink that contains up to 70 wt % of functional pigments.

11. Recording paper in accordance with claim 1 wherein the reverse side of the recording papers is printed with a printing ink whose functional pigments can be magnetized.

12. Recording paper in accordance with claim 1 wherein the reverse side of the recording paper is printed with a printing ink whose functional pigments comprise at least one of iron powder and iron oxide.

13. Recording paper in accordance with claim 1 wherein the printing ink can be crosslinked by UV radiation.

14. Recording papers in accordance with claim 1 further comprising at least one additional imprinted coating covering the printing ink and rendering it barely visible to the naked eye.

* * * * *